United States Patent [19]

Alliot et al.

[11] Patent Number: 4,699,203

[45] Date of Patent: Oct. 13, 1987

[54] PROCESS FOR THE CASTING OF SACRIFICIAL ANODES IN AN INGOT MOULD HAVING A MOVABLE BASE

[75] Inventors: Maurice Alliot, Saint Michel de Maurienne; Jean-Louis Meteau, Paris; Max Reboul, Saint Egreve, all of France

[73] Assignee: Cegedur Societe de Transformation de l'Aluminium Pechiney, Paris, France

[21] Appl. No.: 857,132

[22] Filed: Apr. 29, 1986

[30] Foreign Application Priority Data

Apr. 29, 1985 [FR] France ..... 85 06877

[51] Int. Cl.[4] ..... B22D 11/124

[52] U.S. Cl. ..... 164/461; 164/486

[58] Field of Search ..... 164/98, 107, 459, 461, 164/464, 486

[56] References Cited

U.S. PATENT DOCUMENTS 3,542,116 11/1970 Machlin ..... 164/461

FOREIGN PATENT DOCUMENTS 1944149 3/1971 Fed. Rep. of Germany ..... 164/98

2300528 8/1973 Fed. Rep. of Germany ..... 164/98

58-224049 12/1983 Japan ..... 164/464

*Primary Examiner*—Nicholas P. Godici

*Assistant Examiner*—Richard K. Seidel

*Attorney, Agent, or Firm*—Dennison, Merserole, Pollack & Scheiner

[57] ABSTRACT

The invention relates to a process for casting a sacrificial anode having a tubular steel insert bonded over its length to a dissimilar metal by casting and solidifying molten dissimilar metal on the steel insert in a vertical ingot mold having a movable base. A cooling fluid is passed through a pipe means located internal to the insert, to the level of solidification of the molten dissimilar metal, and the cooling fluid is then applied to the internal surface of the insert at the level of solidification. The level of solidification is raised by the cooling fluid relative to the level without cooling by a height equal to between about $\frac{1}{4}$ and $\frac{3}{4}$ of the maximum height of molten metal in the mold. The bond strength between the steel insert and the dissimilar metal is improved by this method.

5 Claims, 1 Drawing Figure

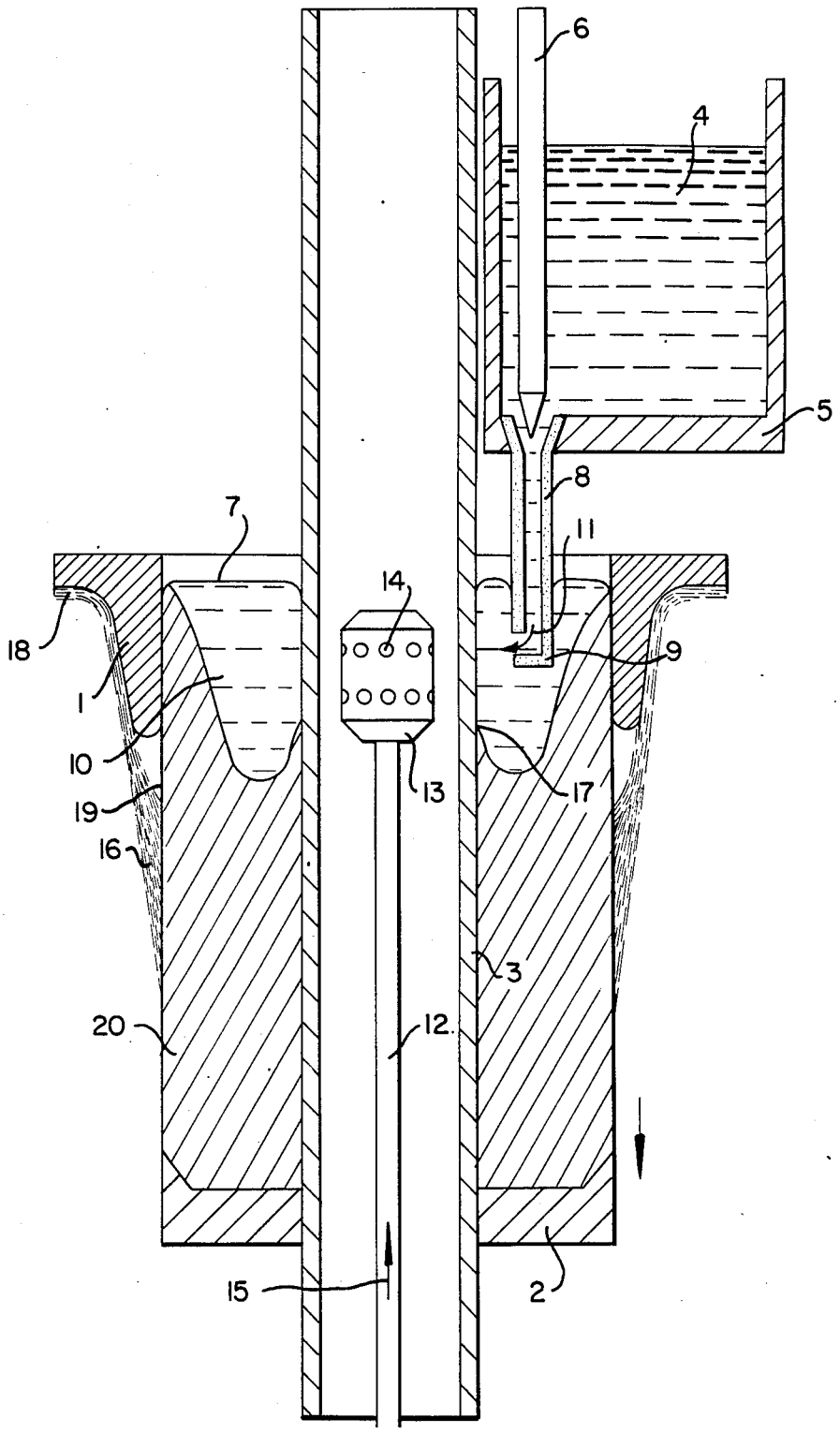
6
4
5
8
7
11
14
18
9
1
10
13
17
19
16
3
20
12
15
2

PROCESS FOR THE CASTING OF SACRIFICIAL ANODES IN AN INGOT MOULD HAVING A MOVABLE BASE

The present invention relates to a process for casting of sacrificial anodes by means of an ingot mould with a movable base.

When a metal such as steel is placed in a corrosive medium such as sea water, for example, it corrodes. This is a problem which is familiar, in particular, to petroleum engineers with their steel maritime rigs.

It has been known for some time that this corrosion can be avoided by electrically connecting the steel structure to be protected to so-called sacrificial anodes constituted by a metal which acts as an anode relative to the steel such as aluminium, zinc and magnesium alloys.

Under these conditions, a galvanic couple is formed which produces on the steel a protective cathode current while consuming the anode.

However, to obtain this protective current it is necessary to produce a good electrical connection between the structure and the anode. This electrical connection is generally obtained by pouring the anode alloy round a steel insert, usually of tubular shape, the insert being welded on the structure to be protected.

The process most frequently used for obtaining such anodes involves pouring the mass of anode metal into a stationary horizontal mould inside which the insert has previously been placed. To facilitate mould release, this mould generally has a trapezoidal shape which results in an anode of asymmetrical cross-section. Experience has shown that this process has several drawbacks. On the one hand, cooling is slow and varies depending on whether the cast metal is in contact with the wall of the mould or with the atmosphere. As a result, heterogeneities are produced in the composition and structure of the anode during solidification. On the other hand, the presence of unsticking and even of cavities between insert and anode are frequently observed. This unsticking can allow infiltration of water along the insert and can put the anode out of operation prematurely. Moreover, cracks are often formed in the case of long and fine anodes, of which some may allow the loss of fragments of anodes when combined with the spaces between anode and insert.

Faced with these difficulties, the applicant, desirous of providing users with anodes of improved quality, has undertaken research and has found that casting in an ingot mould having a movable base could advantageously replace casting in a fixed mould.

Let us remember that this ingot mould method, also called semi-continuous casting, which is widely adopted in foundry practice, in particular for the casting of billets, involves continuously supplying with a molten metal an ingot mould having a vertical axis which is open at the top, is closed at the bottom by a movable base and is cooled externally by a fluid so that the metal soldifies partially inside the ingot mould and becomes integral with the movable base. By the gradual downward movement of the movable base and cooling by spraying the surface of the metal leaving the ingot mould, it is possible to obtain an ingot of the desired length having a contour corresponding to that of the ingot mould which may be, in particular, circular.

However, the application of this method of casting billets to the casting of sacrificial anodes involves certain difficulties due to the presence of an insert and therefore necessitates certain adaptations to the conventional process for the casting of billets. Various modifications of the casting station have therefore been made and involve, in particular, rendering the insert integral with the movable base so as to allow synchronous movement of the assembly during the casting process and to centre this insert relative to the anode mass. The description of such a station has been submitted by the applicant during the annual corrosion congress held by National Association of Corrosion Engineers which was held in Toronto from 6th to 10th April 1981 and published under the reference "CORROSION 81", paper 107.

In this publication, the various advantages of this method over moulding in a fixed mould have been demonstrated, that is:

- a more homogeneous chemical composition,
- a finer texture,
- the absence of separation between the insert and the anode metal,
- the suppression of cracks,
- a symmetrical distribution of the alloy round the insert over its entire length.

However, since 1981, the methods of protection have evolved and the users would now like to have anodes with a cross-section which is relatively larger than those used until now.

In response to this wish, the applicants have encountered new difficulties in the application of the semi-continuous casting method because the increase in the anode diameter to insert diameter ratio resulted in a significant decrease in the mechanical strength of the insert-anode connection and hence a corresponding decrease in the electrical conductivity of the assembly.

In seeking to overcome this deficiency, the applicant has found a process of which the application is particularly effective for improving this strength not only in the case of anodes having a large diameter ratio, but also for the smaller anodes manufactured until now.

This process is characterised in that the interior of the insert is cooled by means of a fluid during casting.

This cooling is preferably localised in the portion of the insert facing the liquid metal during solidification, that is in the region where there is a solid-liquid interface, this region being known by the skilled man as "solidification front".

It is known that in a diametral vertical section and for a billet, this solidification front has approximately the shape of a V of which the point is more or less flattened. This form is due to the particular solidification conditions of the metal during casting. On the one hand, the metal solidifies on contact with the cooled ingot mould, resulting in so-called cortical casting, then the metal is cooled directly as it leaves the ingot mould by a cooling fluid which solidifies the metal to the core in the central portion of the solidification front. The presence of an insert in the centre of the billet has no other effect than to substitute itself for the solidification front in the portion of metal which it occupies, without fundamentally altering the shape, since the temperature of the insert tends to balance with that of the cast metal.

Cooling is preferably localised in this region.

This cooling is not random. In fact, within the scope of the invention it must be sufficient to cause a rise in the central front along the insert, that is for the level of the solidification front in contact with the insert to be located above the level found when there is no cooling.

Cooling should preferably be such that the difference between these two levels is at least equal to $\frac{1}{4}$ of the maximum height of liquid metal in the ingot mould. Below this level, an improvement in the mechanical strength of the insert-anode connection is found, but this improvement is more noticeable once the value indicated is attained.

This level can even attain the upper level of the liquid in the ingot mould, however it then necessitates a large flow rate of refrigerating fluid without increasing the strength. As a result, the flow may be limited so as to attain a difference in level of at most $\frac{3}{4}$ of the maximum height of the liquid metal in the ingot mould.

This cooling is achieved by means of a fluid which may be any gas or any liquid capable of providing the necessary negative kilocalories such as air or water, for example, or dispersions of liquid in a gas, etc.

This fluid is introduced inside the tubular insert at one or other of its ends which is located either above the level of the ingot mould or below the movable base. A tubular rod of which one of the ends is open and the other connected to a source of fluid may be used for this purpose. The open end of this rod is threaded inside the insert and may be moved, in particular, for positioning at the level of the solidification front. The end of the rod situated inside the insert preferably ends with an enlarged portion which allows the fluid to escape only through holes placed on its lateral wall in the form of crowns so as to create jets which allow cooling to the localised better.

These holes are preferably made so as to imprint on the jets a direction which forms with a horizontal plane an angle of between 0 and 60 degrees orientated downwards.

The results of the invention can be further improved by injecting the molten metal into the ingot mould within the not yet solidified metal. Any disturbance inherent in the disordered movements of the liquid metal are thus avoided and the obtaining of greater mechanical strength in the anode-insert join and of a metal of improved quality (without inclusions of oxides, in particular) is assisted.

This injection operation is preferably carried out in a direction perpendicular to the axis of the insert so as to prevent crystals which are already formed close to the central portion of the solidification front from rising along the insert.

These injection conditions are achieved by means of a suitably shaped nozzle which can easily be produced by a skilled person.

The present invention will be understood better by reference to the FIGURE accompanying the present application which represents a vertical section through a casting installation which allows the new methods found by the applicant to be applied.

This FIGURE shows a cylindrical ingot mould 1 equipped with a movable base 2 which closes the ingot mould at the bottom as casting commences. This base is traversed in its centre by a tubular insert 3 arranged so as to be able to travel downwards by a synchronous translation movement during casting. The molten anode metal 4 is injected into the ingot mould by means of a reverse 5 equipped with a flow regulator 6 operating so as to maintain a constant level of liquid 7 in the ingot mould and with a vertical nozzle 8 of which the end 9 is situated within the not yet solidified metal 10 and is directed so as to transmit the flow of metal perpendicularly to the axis of the insert along the arrow 11. A rod 12 of which the end is equipped with an enlargement 13 perforated with holes 14 distributes the fluid admitted at 15 into the portion of the insert facing the solidification front 16 so as to cause it to rise to the level 17 so as to form, under the combined action of cooling by a liquid 18 of the ingot mould 1 and of the surface 19 of the metal leaving the ingot mould, the anode 20 according to the invention.

The present invention may be illustrated by the following embodiment.

An anode metal of the HYDRAL 2C type, that is to say constituted by an aluminium alloy containing 5% of zinc and 0.02% of indium approximately was cast semi-continuously into a cylindrical ingot mould in the form of an anode having a length of 2,500 mm and an external diameter of 260 mm round an insert composed of API-5L quality steel having an external diameter of 114 mm. The first half of the anode was cast by the process of the prior art, that is without internal cooling of the insert; the second half was cast while cooling the insert so as to raise the level of the solidification front in contact with the insert relative to its position in the first portion of casting by a height equal to $\frac{3}{4}$ of the height of liquid in the ingot mould.

In practice, these levels may be determined by means of a probe which is immersed in the liquid metal contained in the ingot mould so as to detect the position of the liquid-solid interface.

In order to demonstrate the effectiveness of the process according to the invention, the mechanical strength of the insert-anode join was measured in the following manner:

The cylindrical anode was cut into slices perpendicularly to the axis which were 100 mm thick and the two faces of each disc were machine turned so as to make them strictly perpendicular to their axis, then each of the discs was introduced successively between the plates of a press having a force of 100,000 daN equipped with special heads allowing the anode of the insert to be separated. This press is provided with instruments and allows the force applied to be recorded directly as a function of the actual movement of the moving plate. The lower moving plate has an opening with a diameter corresponding to the external diameter of the insert. After positioning the axis of the slice along the axis of the opening, the lower plate is raised until the slice comes into contact with the two plates, then this raising is continued so as to exert a pressure which is such that sliding of the anode relative to the insert over a length of 1 mm selected arbitrarily is produced. The indication of the value of this pressure given by a dynamometer.

The following values were found on each of the discs:

| | Force in daN |
|---|---|
| Part cast according to the prior art | 8750- 9500- 8125- 6875 |
| Part cast according to the invention | 39500- 33500- 26250- 32500- 39500- 38750- 27750 |

These results show that the force required for causing the anode to travel relative to the insert is much greater when the anode is cast by the process according to the invention.

These values translated into measurements of adhesion, that is in force related to the $mm^2$ of anode-insert contact surface, give the following results:

Average Adhesion in daN/mm$^2$
According to the Prior Art: 0.229
According to the Invention: 0.939.

The same measurements taken on an anode of identical composition with an identical insert cast under cooling conditions such that the difference of level between the front in contact with the insert and the lowest front is $\frac{1}{4}$ of the height of liquid in the ingot mould resulted in an average adhesion value of 0.819 daN/mm$^2$.

These numbers indicate clearly that the invention allows the mechanical strength of the anode-insert join to be improved significantly and this accordingly contributes to a significant improvement in the electrical conductivity of the anode and consequently its efficiency.

The present invention is adopted in the manufacture of sacrificial anodes having an anode-insert join of high mechanical strength which are intended, in particular, for the corrosion-protection of cathode structures relative to the anode material and which may be, for example, oil exploitation and drilling rigs at sea, pipelines, the hulls of boats, etc.

We claim:

1. In a process for casting a sacrificial anode having a tubular steel insert bonded over its length to a dissimilar metal by casting and solidifying molten dissimilar metal on said steel insert in a vertical ingot mold having a movable base, the improvement comprising passing a cooling fluid through a pipe means located internal to said insert, to the level of solidification of said molten dissimilar metal, and applying said cooling fluid to the internal surface of said insert at the level of solidification, the level of solidification being raised by said cooling fluid relative to the level without cooling by a height equal to between about $\frac{1}{4}$ and $\frac{3}{4}$ of the maximum height of molten metal in the mold, whereby the bond strength between the steel insert and the dissimilar metal is improved.

2. A process according to claim 1, characterised in that the fluid is applied to the internal wall of the insert in the form of jets.

3. A process according to claim 2, characterised in that the direction of the jets forms with a horizontal plane a downwardly orientated angle of between 0° and 60°.

4. A process according to claim 1, characterised in that the molten dissimilar metal is injected into the ingot mould within the not yet solidified metal.

5. A process according to claim 4, characterised in that the dissimilar metal is injected in a direction perpendicular to the axis of the insert.

* * * * *